US009754262B2

(12) United States Patent
Smyers et al.

(10) Patent No.: US 9,754,262 B2
(45) Date of Patent: Sep. 5, 2017

(54) AMASSING INFORMATION ABOUT COMMUNITY PARTICIPANT BEHAVIORS

(75) Inventors: Scott Smyers, Carlsbad, CA (US); Mark Eyer, Woodinville, WA (US)

(73) Assignees: SONY ELECTRONICS INC., Parkridge, NJ (US); SONY CORPORATION, Tokyo (JP)

( * ) Notice: Subject to any disclaimer, the term of this patent is extended or adjusted under 35 U.S.C. 154(b) by 2715 days.

(21) Appl. No.: 12/112,875

(22) Filed: Apr. 30, 2008

(65) Prior Publication Data

US 2009/0276230 A1 Nov. 5, 2009

(51) Int. Cl.
*G06Q 30/00* (2012.01)

(52) U.S. Cl.
CPC ..... *G06Q 30/00* (2013.01)

(58) Field of Classification Search
CPC ..... G06Q 10/00
USPC ..... 705/14.49, 14
See application file for complete search history.

(56) References Cited

U.S. PATENT DOCUMENTS

| | | | | |
|---|---|---|---|---|
| 6,226,622 | B1 | 5/2001 | Dabbiere | |
| 6,714,975 | B1 * | 3/2004 | Aggarwal et al. | 709/224 |
| 7,768,682 | B2 * | 8/2010 | Mestha | G06K 15/02 345/589 |
| 8,930,204 | B1 * | 1/2015 | Igoe | G06F 17/30699 705/2 |
| 2003/0088463 | A1 * | 5/2003 | Kanevsky et al. | 705/14 |
| 2004/0164897 | A1 | 8/2004 | Treadwell et al. | |
| 2005/0193012 | A1 * | 9/2005 | Matsuyama et al. | 707/104.1 |
| 2005/0210387 | A1 * | 9/2005 | Alagappan et al. | 715/700 |
| 2006/0143068 | A1 * | 6/2006 | Calabria | 705/10 |
| 2006/0195361 | A1 * | 8/2006 | Rosenberg | 705/14 |
| 2007/0094042 | A1 * | 4/2007 | Ramer et al. | 705/1 |
| 2007/0118661 | A1 * | 5/2007 | Vishwanathan et al. | 709/227 |

(Continued)

FOREIGN PATENT DOCUMENTS

| | | |
|---|---|---|
| JP | 9053957 | 2/1997 |
| JP | 2004171408 | 6/2004 |

OTHER PUBLICATIONS

Liao et al.; "Extracting Places and Activities From GPS Traces Using Hierarchical Conditional Randome Fields"; Jan. 2007; vol. 2, Issue 1; International Journal of Robotics Research; pp. 1-20.

(Continued)

*Primary Examiner* — Bruce I Ebersman
(74) *Attorney, Agent, or Firm* — Chip Law Group

(57) ABSTRACT

Particular embodiments provide recommendations based on community affiliation. In one embodiment, the method determines a query from a target user. A community in which the target user is a member is then determined. The community may include a plurality of members that have joined the community based on a common interest. User activity information is analyzed for at least a portion of the members of the community to determine a recommendation for the query. The user activity information is determined to be of interest to the target user based on the target user's membership in the community. For example, based on the user's membership in the community, recommendations as to what other members in the community liked can be correlated to the query for the target user. Thus, the recommendation may be provided to the user based on what other users in the community liked.

20 Claims, 4 Drawing Sheets

(56) References Cited

U.S. PATENT DOCUMENTS

| | | | | |
|---|---|---|---|---|
| 2007/0168208 | A1* | 7/2007 | Aikas et al. | 705/1 |
| 2007/0276735 | A1* | 11/2007 | Naito | 705/14 |
| 2008/0028036 | A1* | 1/2008 | Slawson et al. | 709/217 |
| 2008/0077309 | A1* | 3/2008 | Cobbold | 701/117 |
| 2008/0214148 | A1* | 9/2008 | Ramer et al. | 455/414.1 |

OTHER PUBLICATIONS http://www.researchchannel.org/prog/dispalyevent.aspx?rID=4894 &fID=569—pp. 1-2.

* cited by examiner

AMASSING INFORMATION ABOUT COMMUNITY PARTICIPANT BEHAVIORS

BACKGROUND

Particular embodiments generally relate to providing recommendations based on community affiliation.

The Internet allows like-minded people to join groups together. For example, users interested in the same subject matter may together join blogs, chat rooms, newsgroups, etc. In these examples, users may read other users' posts about the subject matter. For example, if a user subscribes to a blog about political views, the user would receive any posts from other users about the political subject matter. Reading other users' posts about the subject matter, however, is where the connection ends for the group. That is, the group is limited to expressing views about the political subject matter.

SUMMARY

Particular embodiments provide recommendations based on community affiliation. In one embodiment, the method determines a query from a target user. A community in which the target user is a member is then determined. The community may include a plurality of members that have joined the community based on a common interest. User activity information is analyzed for at least a portion of the members of the community to determine a recommendation for the query. The user activity information is determined to be of interest to the target user based on the target user's membership in the community. For example, based on the user's membership in the community, recommendations as to what other members in the community liked can be correlated to the query for the target user. In one example, if the user is in Prague and has joined a music community, and other users in the music community have indicated they liked a restaurant, that restaurant may be determined as the recommendation. Thus, the recommendation may be provided to the user based on what other users in the community liked. In this case, it is expected that like-minded individuals may prefer similar things. Even though music does not have a direct relationship to food, it is possible that people that share other interests (music) may prefer similar restaurants.

A further understanding of the nature and the advantages of particular embodiments disclosed herein may be realized by reference of the remaining portions of the specification and the attached drawings.

DETAILED DESCRIPTION OF EMBODIMENTS

Figure 1:
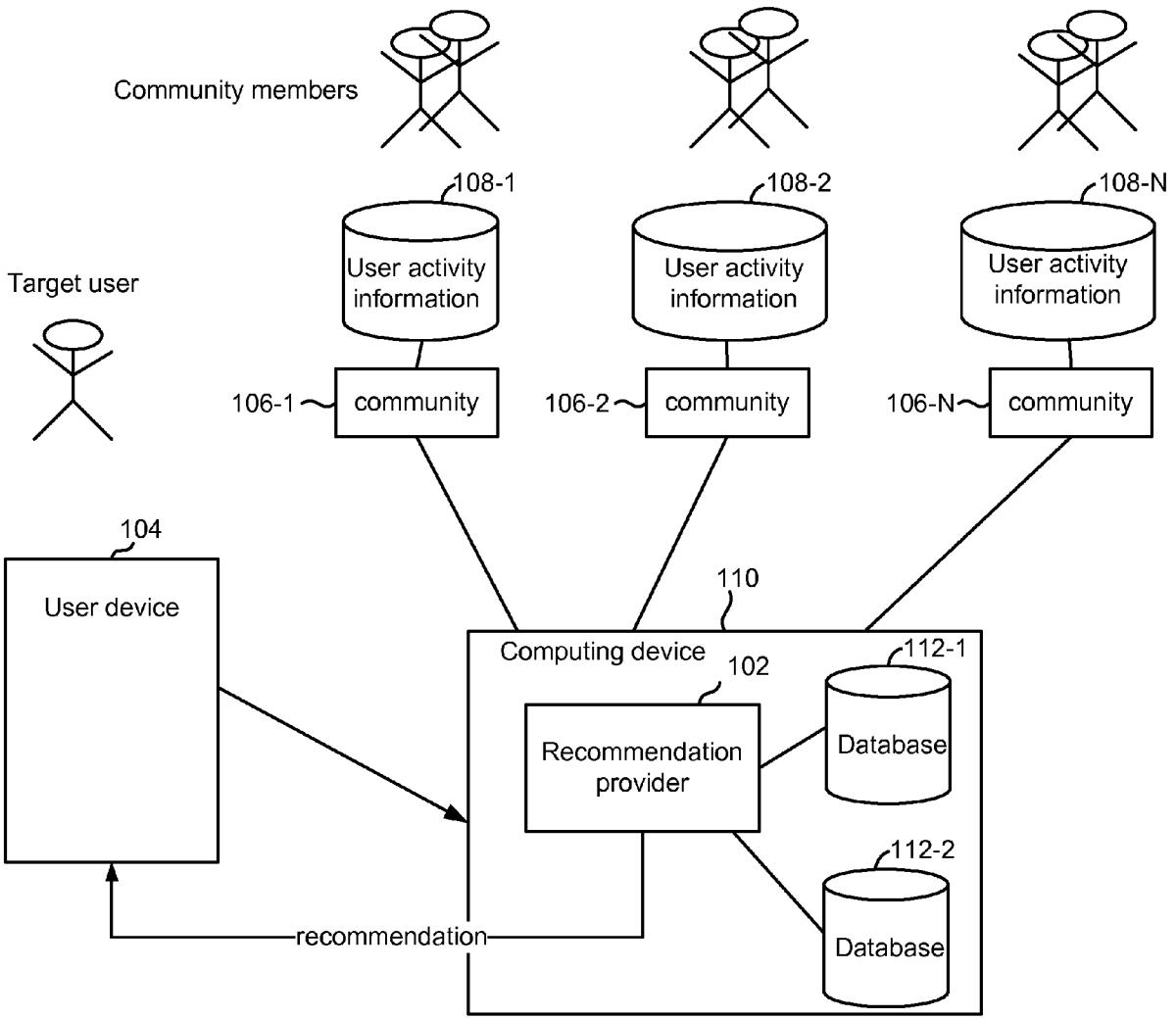
FIG. 1 depicts a system for providing recommendations based on community according to one embodiment.

FIG. 1 depicts a system for providing recommendations based on community according to one embodiment. As shown, a recommendation provider 102 is configured to output recommendations. A target user may use a user device 104 to interact with recommendation provider 102.

User device 104 may be any computing device used by the target user. For example, user device 104 may include a personal computer, laptop computer, cellular phone, set top box, smart phone, etc. In one embodiment, user device 104 may send a query to recommendation provider 102. The query may be input by a user, such as the user may be searching for a restaurant. Once receiving the query, recommendation provider 102 may output a recommendation. In other embodiments, recommendation provider 102 may automatically determine a query and recommendation for the target user. For example, recommendation provider 102 may determine that the user is in a certain location using global positioning satellite (GPS) information and determine a query to be "restaurants in the <location>".

Recommendation provider 102 may be part of a computing device 110. For example, user device 104 may communicate over a network to computing device 110. In one embodiment, computing device 110 may be a server and user device 104 may be a client communicating over the Internet or any other wide area network (WAN). It will be understood that the functions of recommendation provider 102 may be distributed among multiple computing devices including user device 104.

A plurality of communities 106 may be provided. A community may be any group in which users can join. For example, communities may be organized by interests. Examples of communities may include users who like certain music bands, certain video games, certain intellectual ideas, blog-rings, etc. Each community 106 may include community members. The community members may affirmatively join a community. For example, members may register for the community or perform any other action to join the community.

Users may join communities 106 based on their interest in the community. For example, communities may be determined from various websites. If a user is using a social networking site, the user may join different communities that are associated with different friends. For example, user may join a community that includes all their friends, people from the same college, people with the same interests, etc. Also, on a different website, a user may join other communities, such as users may be associated with different communities on a blog.

Community members, who may include the target user, may store user activity information in databases 108. The user activity information may be any information about user activities. For example, activities may include restaurants or other establishments visited and also when (e.g., on weekends, weekdays, breakfast, lunch, dinner, during major holidays). Other activities may include information from a user's calendar or appointment book, information for a user's travels to different locations, other events that a user has participated in, etc.

User activity information may also include user-embellished information from each member. For example, a member's state of mind or quality of experience at a restaurant may be used to embellish the information that a user went to a certain restaurant.

Recommendations may then be provided taking into account the user activity information for other users in a community. For example, if the target user joined community 106-1, user activity information for community members that also had joined community 106-1 may be used to provide a recommendation. In one embodiment, community 106-1 may be associated with a certain interest or subject matter, such as travel. However, the recommendations are not limited to what the community is about. For example, recommendations on restaurants may be provided. The community provides a way of identifying like-minded individuals. However, the recommendations provided assume that if a like-minded individual liked a certain restaurant, then it is possible that the target user may like this restaurant. In a specific example, if a user is in Prague, if certain community members were also in Prague and liked a restaurant, then that restaurant may be recommended.

The following will now discuss in greater detail the creation of the user activity information and also the generation of recommendations.

Figure 2:
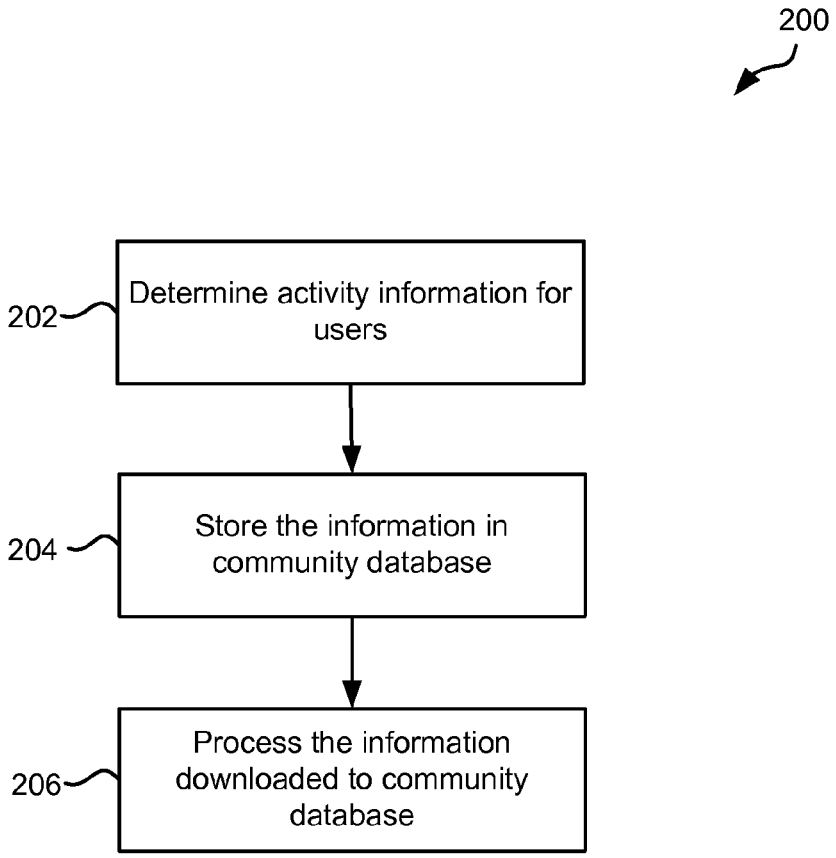
FIG. 2 depicts an example of determining user activity information according to one embodiment.

FIG. 2 depicts an example of determining user activity information according to one embodiment. Step 202 determines activity information for users. This activity information may be information that may be uploaded by a user. For example, the user's blog may indicate that he/she is traveling to Eastern Europe for a vacation. Recommendation provider 102 may automatically detect this in the blog and determine that the user is traveling to these places. Also, an appointment book for a user may be used to determine user activity information. In one example, an appointment may indicate that the user was in a meeting with another user at a certain restaurant. Further, the user may use a user interface to indicate where he/she is traveling.

In one embodiment, a data recorder may capture a continuous record of a user's travels in a machine-readable form. In one embodiment, the data recorder captures time and global positioning satellite (GPS) location information. The data recorder may then be connected to user device 104 and it may download the location and/or time information and any other information to community database 112. The mapping information may be used to determine the establishments visited by the user using GPS information. Also, time information may be used to determine how long the user stayed at the establishment, which route was taken to get to the establishment, etc.

Step 204 then stores the information in community database 112 (e.g., database 112-1, database 112-2, etc.). For example, when a user connects the data recorder to a network, the information may be downloaded to community database 112. Also, a user may embellish the information stored by using a user interface to indicate an opinion about a place, rate a place, or provide any other metadata.

Step 206 processes the information downloaded to community database 112. For example, the location information may be used to determine which establishments were visited. In one example, GPS readings may be translated into an area where a restaurant is located and it is then determined the user had visited that restaurant. Further, blogs may be parsed to determine what activities the user had participated in. For example, if a user blogged about going out to a certain bar, going to a certain conference, etc., user activity information is stored for the bar, conference, etc. Also, if the user expressed an opinion about the bar, conference, etc. in the blog, the opinion may be associated with the user activity information stored.

Accordingly, the user activity information is stored for each user in community database 112. A record of what activities the user has performed may be provided and used to determine recommendations for other users. The user activity information may be indexed by the user and/or aggregated together.

Figure 3:
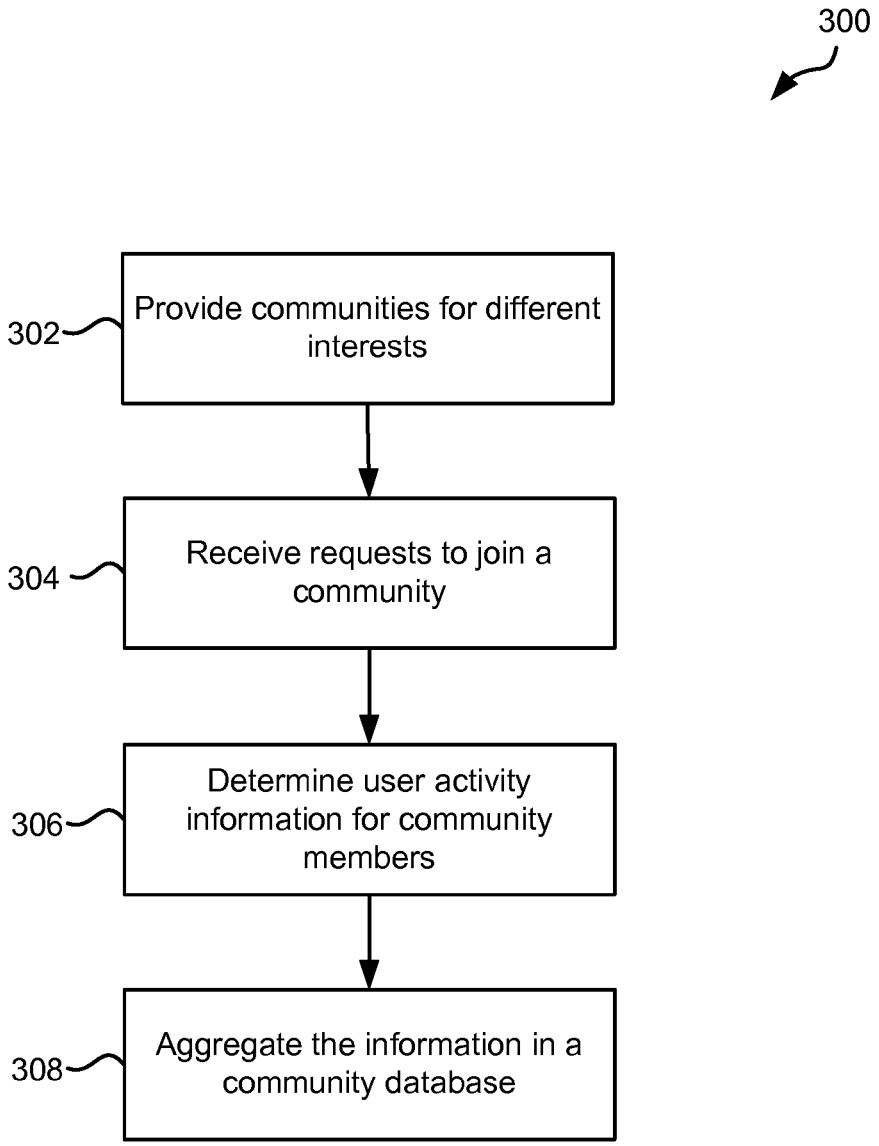
FIG. 3 depicts a simplified flowchart of a method for creating a user activity database 108 according to one embodiment.

FIG. 3 depicts a simplified flowchart 300 of a method for creating a user activity database 108 according to one embodiment. Step 302 provides communities for different interests. In one embodiment, the communities may be provided by recommendation provider 102. In other embodiments, communities may be determined from different websites that users use. For example, participation in certain blogs or social networking sites, or regular visits to other websites may be used to define communities.

Step 304 receives requests to join a community. As mentioned above, the request may be received from the user through different websites. In this way, users may associate themselves with different communities based on their own interests.

Step 306 determines user activity information for community members. For example, each community member may include a user activity database 108. Information regarding user activities may be stored in user activity database 108. In one embodiment, users may specify which user activity information may be stored for the community. Thus, users may be assured of their own privacy in that certain user activity information may not be stored or accessible by recommendation provider 102.

Step 308 then aggregates the information in a community database 112. Community database 112 may be a database that aggregates the user activity information for each community. Thus, user activity information may be uploaded from users and aggregated together. In this case, queries may be run against the community database to determine recommendations.

Figure 4:
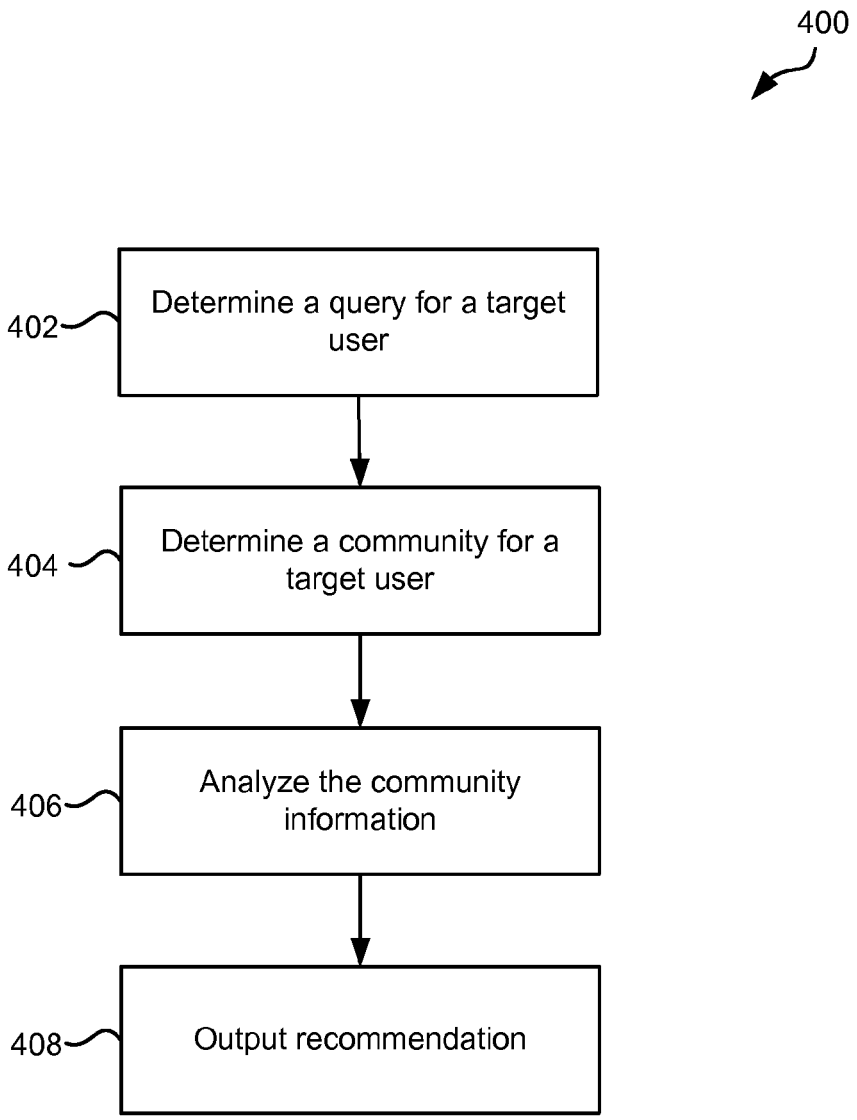
FIG. 4 depicts a simplified flowchart for determining recommendations according to one embodiment.

FIG. 4 depicts a simplified flowchart 400 for determining recommendations according to one embodiment. Step 402 determines a query for a target user. The query may be determined in different ways. In one example, a user may directly input a query into user device 104 and have it send to recommendation provider 102. For example, a web page may be used where a user enters a query into an input box. The query may be "what restaurants are good in Prague". Also, the query may be automatically determined by recommendation provider 102. For example, the user may be in a city, such as Prague. In this case, GPS information may be used to determine that the user is in Prague. Recommendation provider 102 may automatically determine a query that since the user is in Prague, which may be "what restaurants other community members liked while in Prague".

Step 404 determines a community for a target user. For example, any community that a target user has previously joined may be determined.

Step 406 analyzes the community information. For example, a query is correlated with similar information in community database 112. If the user is in Prague, users in the community that have been to Prague are determined. Then, other information associated with the users that have been to Prague is determined. This may be restaurants that the other users liked while they were in Prague. Accordingly, community information for the other users is used to provide the recommendations. It is expected that like-minded individuals join in the community because they have an interest. Also, it may be expected that what other community members liked the target user will like.

In step 408, the recommendation is outputted. For example, a recommendation may be sent to user device 104 for display. Also, the recommendation may be stored, emailed, etc.

In one example, a user may be associated with the rock group Police fan club community. When a target user is traveling, the user may be in the city Prague. Recommendation provider 102 may determine that the user is in Prague and generate a recommendation. For example, other community members who are associated with the Police Fan Club liked Club Animal when they happened to be in Prague. Thus, a recommendation may be that the user should go to Club Animal.

In another example, user may participate in a blog about Leonardo da Vinci. Recommendation provider 102 may detect that a user is in Tuscany and determine that other community members have liked Café Maggiore. When a user is nearby Café Maggiore, recommendation provider 102 may send a message to the user that he/she is a block away from Café Maggiore and the user might like the café because other members of the community also liked the café while in Tuscany.

Although the description has been described with respect to particular embodiments thereof, these particular embodiments are merely illustrative, and not restrictive.

Any suitable programming language can be used to implement the routines of particular embodiments including C, C++, Java, assembly language, etc. Different programming techniques can be employed such as procedural or object oriented. The routines can execute on a single processing device or multiple processors. Although the steps, operations, or computations may be presented in a specific order, this order may be changed in different particular embodiments. In some particular embodiments, multiple steps shown as sequential in this specification can be performed at the same time.

Particular embodiments may be implemented in a computer-readable storage medium for use by or in connection with the instruction execution system, apparatus, system, or device. Particular embodiments can be implemented in the form of control logic in software or hardware or a combination of both. The control logic, when executed by one or more processors, may be operable to perform that which is described in particular embodiments.

Particular embodiments may be implemented by using a programmed general purpose digital computer, by using application specific integrated circuits, programmable logic devices, field programmable gate arrays, optical, chemical, biological, quantum or nanoengineered systems, components and mechanisms may be used. In general, the functions of particular embodiments can be achieved by any means as is known in the art. Distributed, networked systems, components, and/or circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

We claim:

1. A method for providing recommendations based on community information, the method comprising:

in a computing device configured to communicate with an electronic device via a communication network, wherein the computing device comprises at least one processor and logic encoded in at least one tangible medium for execution by the at least one processor, and the logic when executed causes the at least one processor to perform the steps, comprising:

determining, by the at least one processor, a query received from the electronic device associated with a target user via the communication network;

determining, by the at least one processor, a community in which the target user is one of a plurality of members, wherein the community is organized based on a common interest of the plurality of members, wherein the query is for a subject matter that is outside of the common interest of the community;

collecting user activity information including one of global positioning system (GPS) location information from at least one user activity information database, or event information from a calendar database of the target user;

receiving a download of the user activity information from a data recorder;

aggregating, by the at least one processor, the collected and the received user activity information associated with the plurality of members in a community database on the computing device;

analyzing, by the at least one processor, the user activity information associated with at least a portion of the plurality of members by accessing the aggregated user activity information from the community database to determine a recommendation for the query, wherein the recommendation is determined to be of interest to the target user by correlating the query to the user activity information for the plurality of members of the community other than the target user; and outputting the recommendation from the computing device to the electronic device of the target user.

2. The method of claim 1, wherein the aggregating further comprises:

storing the user activity information, collected from the at least one user activity information database electronically accessible over the communication network, in the community database.

3. The method of claim 2, wherein collecting further comprises capturing location information regarding activities participated in by the plurality of members.

4. The method of claim 3, wherein the capturing location information comprises receiving periodically captured time and the global positioning system (GPS) location information from the plurality of members, wherein the time and GPS location information is received by the computing device from the communication network.

5. The method of claim 3, wherein the capturing of the location information further comprises:

accessing the event information from the calendar database of the target user; and determining the recommendation based on the accessed event information.

6. The method of claim 1, wherein the user activity information comprises user opinion information for activities in the user activity information.

7. The method of claim 1, wherein the aggregated user activity information is used to determine an activity preferred by the plurality of members in the community, wherein the preferred activity is determined as the recommendation.

8. The method of claim 1, wherein determining the query comprises automatically determining the query based on the user activity information for the target user.

9. The method of claim 1, wherein the data recorder is configured to record information for a user's activities.

10. The method of claim 1, further comprising analyzing user uploaded information for the community to determine the user activity information.

11. An apparatus configured to provide recommendations based on community information, the apparatus comprising:

at least one processor configured to communicate with an electronic device via a communication network;

logic encoded in at least one tangible medium for execution by the at least one processor, and when executed being operable to:

determine a query received from the electronic device associated with a target user via the communication network;

determine a community in which the target user is one of a plurality of members, the community being organized based on a common interest of the plurality of members, wherein the query is for a subject matter that is outside of the common interest of the community;

collect user activity information including global positioning system (GPS) location information from at least one user activity information database, or event information from a calendar database of the target user;

receive a download of the user activity information from a data recorder;

aggregate the collected and the received user activity information associated with the plurality of members in a community database on the apparatus;

analyze the user activity information associated with at least a portion of the plurality of members based on the aggregated user activity information from the community database to determine a recommendation for the query, wherein the recommendation is determined to be of interest to the target user based on correlation of the query to the user activity information for the plurality of members of the community other than the target user; and output the recommendation from the apparatus to the target user.

12. The apparatus of claim 11, wherein the logic when executed to aggregate is further operable to:

store the user activity information, collected from the at least one user activity information database electronically accessible over the communication network, in the community database.

13. The apparatus of claim 12, wherein logic operable to collect further comprises logic operable to capture location information regarding activities participated in by the plurality of members.

14. The apparatus of claim 13, wherein the location information capture comprises reception of periodically captured time and the global positioning system (GPS) location information from the plurality of members, wherein the time and GPS location information is received by the apparatus from the communication network.

15. The apparatus of claim 13, wherein the capture of the location information comprises:

access of the event information from a calendar database of the target user; and determine the recommendation based on the accessed event information.

16. The apparatus of claim 11, wherein the user activity information comprises user opinion information for activities in the user activity information.

17. The apparatus of claim 11, wherein the aggregated user activity information is used to determine an activity preferred by the plurality of members in the community, wherein the preferred activity is determined as the recommendation.

18. The apparatus of claim 11, wherein logic operable to determine the query comprises logic operable to automatically determine the query based on the user activity information for the target user.

19. The apparatus of claim 11, wherein the data recorder is configured to record information for a user's activities.

20. The apparatus of claim 11, wherein the logic when executed is further operable to analyze user uploaded information for the community to determine the user activity information.

* * * * *